United States Patent [19]

Kajioka et al.

[11] Patent Number: 4,848,960

[45] Date of Patent: Jul. 18, 1989

[54] FINISHING MACHINE FOR A CONCRETE SURFACE

[75] Inventors: Yasuo Kajioka; Akira Okada; Tomio Komine; Satoru Shimizu, all of Tokyo, Japan

[73] Assignee: Shimizu Construction Company Limited, Tokyo, Japan

[21] Appl. No.: 177,995

[22] Filed: Apr. 5, 1988

[30] Foreign Application Priority Data

| | | | |
|---|---|---|---|
| Apr. 15, 1987 | [JP] | Japan | 62-93872 |
| Jul. 6, 1987 | [JP] | Japan | 62-104370[U] |
| Dec. 14, 1987 | [JP] | Japan | 62-190373[U] |
| Dec. 25, 1987 | [JP] | Japan | 62-197020[U] |

[51] Int. Cl.[4] ..... E01C 19/22

[52] U.S. Cl. ..... 404/112; 51/177

[58] Field of Search ..... 404/112, 85; 51/177; 425/445, 62, 458; 15/49 R, 52, 98

[56] References Cited

U.S. PATENT DOCUMENTS

| | | | |
|---|---|---|---|
| 2,394,274 | 2/1946 | Troxell | 404/112 |
| 2,869,442 | 1/1959 | Mincher | 51/177 X |
| 2,882,805 | 4/1959 | Sieber | 404/112 |
| 2,942,536 | 6/1960 | Irwin | 404/112 |
| 3,062,107 | 11/1962 | Mitchell | 404/112 |
| 3,367,250 | 2/1968 | Ytterberg | 404/112 |
| 4,320,986 | 3/1982 | Morrison | 404/112 |
| 4,603,999 | 8/1986 | Laditka | 404/112 |
| 4,676,691 | 6/1987 | Morrison | 404/112 |
| 4,775,306 | 10/1988 | Kikuchi et al. | 404/112 X |

*Primary Examiner*—Jerome W. Massie
*Assistant Examiner*—Matthew Smith
*Attorney, Agent, or Firm*—Ladas & Parry

[57] ABSTRACT

The present invention provides a finishing machine for a concrete surface comprising a body which supports a plurality of rotatable trowels with a plurality of trowel blades through radial support members so that the trowels can revolve around the central axis of the body, the body being equipped further with a driving device of the rotatable trowels, a power generator and traveling rollers of the finishing machine which is placed just below the central axis, wherein the driving device of the rotatable trowels is a gasoline engine, and wherein each rotatable trowel is driven by a transmission shaft branched off from a gearbox. The angle between the surface of revolution of each rotatable trowel and the concrete surface is minutely changeable by an angle adjustment mechanism.

19 Claims, 9 Drawing Sheets

FINISHING MACHINE FOR A CONCRETE SURFACE

BACKGROUND OF THE INVENTION

1. Field of the Invention

The present invention relates to a finishing machine of concrete surface comprising rotatable trowels for leveling the surface of deposited concrete, and more specifically to a finishing machine of concrete surface with which the efficiency of automated finishing work on the surface is improved.

2. Background Art

In the past, the finishing work of the surface of concrete consisted of the following steps: placing concrete; laying mortar on it thereafter; and leveling the surface of the mortar. However, this mortar finishing method has drawbacks that the mortar layer scales off and cracks appear therein. In addition, the plastering work requires a great deal of skill and labor and the environment has become worse with this finishing method. In order to avoid these drawbacks, finishing according to the so-called "Monolithic method" has been utilized in which the surface of concrete is directly finished before it hardens. As a result, when level finishing work is carried out by plasterers after concrete is placed, there have arised problems that high working speed is required in summer because of fast setting of concrete and that labor management till midnight may sometimes be necessary in winter. So as to solve these new problems, the working conditions have been improved step by step as follows: plastering work using a trowel was mechanized; working speed was increased by using a mechanically rotatable single trowel; labor of plasterers was reduced and posture of the plasterers during the work became more comfortable; a plurality of rotatable trowels were used; and finally a finishing machine of concrete surface was realized in which control devices are integrated in the body thereof as well as the rotatable trowels. Owing to these improvements, mechanization of surface finishing work of concrete not yet hardened has been realized, which has lead to the reduction of labor of plasterers and to automatization of the finishing work. However, it is not very long since the robotization of such a finishing machine of concrete surface began, and, in general, the working capacity of the machine has not yet fully developed.

At present, the finishing machine of concrete surface is automated to the point that electromotive rotatable trowels are integrated in a single body so that they are able to move automatically and work on the concrete surface by revolution both on its axis and around the central axis of the machine. In the course of step-by-step development so far, several problems have been encountered. The performance of the machine must always be adapted to the succeeding working step by taking into account the nature of concrete.

The first problem relates to the weight of finishing machine. So as to lighten the machine and limit the pressure exerted by the trowels to the concrete surface, aluminum members which are not strong enough and high in cost are used as frames and the number and nature of equipments mounted to the machine are also restricted. Finishing machines of concrete surface so far developed are electromotive in which a plurality of rotatable trowels are each equipped with an electric motor, which leads to a too heavy machine. The second problem originates from he necessity of supplying electric power to the electric motors when the finishing machine is traveling. Because the body of the finishing machine always trails cables for power supply, the cables risk not only to damage the concrete surface under finishing treatment but also to get twisted around the rotatable trowels and in the worse they may be cut by the latter. In order to avoid these problems, various attempts have been made. However, each attempt has generated another new restriction. The third problem relates to the improvement of precision of the finished surface and the realization of high working speed. For this purpose, the speed of revolution of rotatable blades around their axis is chosen to be between 70 and 80 r.p.m. and accordingly the traveling speed of the finishing machine is determined to be 6 m/min. However, the speed of revolution of the rotatable trowels around their axis is so high that the concrete surface tends to be disturbed in the early stage of finishing as in that by a float. Therefore, the lifetime of the trowels is shortened. In addition, the total floor area treated by the finishing machine, 3,500 $m^2$, is not sufficient. The fourth problem relates to the noise made by engines when the means for driving each of the trowels is changed from electric motors to engines. If the finishing work after the placement of concrete is prolonged till midnight, noise made by the engines disturbs the silence in the neighborhood. These problems described just above still remain to be solved.

The present invention was accomplished through intensive research in view of avoiding the above-mentioned drawbacks of the actual electric finishing machine of concrete surface to provide an excellent finishing machine of concrete surface with a gasoline engine which is mounted to the machine as a result of reexamination of the construction of the rotatable trowels from the point of view of their working capacities.

Another object of the present invention is to provide a finishing machine of concrete surface which is not only capable of finishing the surface of deposited concrete with high precision depending on its surface state but also adaptable to the driving means mentioned above and to the nature of concrete by equipping the support members which support rotatable trowels of the prior art with a means for angle adjustment so as to change the angle of the surface of revolution of the rotatable trowels with the concrete surface through the support members and accordingly to change the speed of revolution of the rotatable trowels around the axis of the finishing machine.

Another object of the present invention is to provide a finishing machine of concrete surface which is capable of executing the finishing work depending on the degree of hardening of concrete by equipping the finishing machine with a means for adjusting contact pressure of the traveling means of the finishing machine and that of the rotatable trowels with the concrete surface which changes the ratio between the contact pressure with the concrete surface of the rotatable trowels and that of the traveling means.

A further object of the present invention is to provide, based on the finding that the number of rotatable blades is preferable to be 5 without restricting it to be 3, a finishing machine of concrete surface in which the lifetime of the trowels is prolonged, the noise is reduced, and a reduction in cost is realized by increasing the supporting area of the rotatable blades on the concrete surface to increase the total supporting force, which makes it possible not to use lightweight frames, and accordingly by equipping the finishing machine with a small engine with smaller rotation frequency.

Yet another object of the present invention is to simplify the structure of transmission shafts by arranging them equally around the central axis of the finishing machine toward the radial direction while making the central axis pass through a gearbox so as to leave freedom to the position of the engine in distributing the output power from the engine toward each rotatable trowel through the gearbox.

Yet further but not the last object of the present invention is to provide a finishing machine of concrete surface in which the noise level is lowered by using belts instead of transmission shafts to transmit the output power from the engine toward each rotatable trowel.

DISCLOSURE OF THE INVENTION

The basic idea of the present invention is to equip a finishing machine with a gasoline engine as the means for driving rotatable trowels and to transmit its output power through a gearbox toward each of the rotatable trowels which are arranged radially around the central axis. Therefore, the finishing machine for a concrete surface according to the present invention comprising a body which supports a plurality of rotatable trowels with a plurality of trowel blades through radial support members so that the trowels can revolve around the central axis of the body, the body being equipped further with a driving means of the rotatable trowels, a power generator and a traveling means of the finishing machine which is placed just below the central axis, is characterized in that the driving means of the rotatable trowels is a gasoline engine, and wherein each rotatable trowel is driven by a universal shaft branched off from a gearbox and the angle between the surface of revolution of each rotatable trowel and the concrete surface is minutely changeable by using a means for angle adjustment which is formed at the base portion of the support members. The gearbox may be positioned at the center of the body by making the central axis passing through it so as to make an improvement for simplifying the transmission mechanism of the driving power to the rotatable trowels.

Next, there is provided a finishing machine of concrete surface according to the second invention comprising a body which supports a plurality of rotatable trowels with a plurality of trowel blades through radial support members so that the trowels can revolve around the central axis of the body, the body being equipped further with a driving means of the rotatable trowels, a power generator and a traveling means of the finishing machine which is placed just below the central axis, wherein the means for angle adjustment is formed at the position where the support members are divided into two portions and a horizontal axis connects the two portions so that one of the two portions can pivot for angle adjustment around the axis. The device for angle adjustment may comprise turnbuckles whose ends are each fixed to the two portions of the support members so that the angle between the two portions can be changed. Furthermore, it is possible to divide the vertical axis of each rotatable trowel into two portions for connecting them with a horizontal axis so that one of the two portions can pivot around the horizontal axis.

The third invention relates to a finishing machine of concrete surface comprising a body which supports a plurality of rotatable trowels with a plurality of trowel blades through radial support members so that the trowels can revolve around the central axis of the body, the body being equipped further with a driving means of the rotatable trowels, a power generator and a traveling means of the finishing machine which is placed just below the central axis, wherein a means for adjusting contact pressure of the traveling means and the rotatable trowels with the concrete surface is mounted to the central axis. The means for adjusting contact pressure may be realized, for example, by a spring around the central axis and a shim plate. The shim plate is inserted to or taken away from the predetermined position of the central axis to adjust the height of the frame by the thickness of the shim plate. The height of the frame may also be adjusted by raising or lowering the spring seat against the central axis. Moreover, it is possible to thread the central axis to adjust the height of the frame by screwing the spring seat forward or backward along the central axis.

The fourth invention relates to a finishing machine of concrete surface comprising a body which supports a plurality of rotatable trowels with a plurality of trowel blades through radial support members so that the trowels can revolve around the central axis of the body, the body being equipped further with a driving means of the rotatable trowels, a power generator and a traveling means of the finishing machine which is placed just below the central axis, wherein the trowel blades of the rotatable trowels comprise a means for limiting their swinging motion, the means for limiting swing being supported by a pair of upper and lower brackets which are connected together by an axis at the end of the second support member extending radially from the vertical axis of the rotatable trowel, and an elastic member being interposed between these brackets for limiting their relative motion.

Finally, in the fifth invention, a gasoline engine is used as a means for driving the rotatable trowels of the finishing machine of concrete surface just as in the basic invention. However, the output power from the engine is transmitted to the rotatable trowels through belts according to the fifth invention. Therefore, this fifth invention relates to a finishing machine of concrete surface comprising a body which supports a plurality of rotatable trowels with a plurality of trowel blades through radial support members so that the trowels can revolve around the central axis of the body, the body being equipped further with a driving means of the rotatable trowels, a power generator and a traveling means of the finishing machine which is placed just below the central axis, wherein the driving means of the rotatable trowels is a gasoline engine, and wherein each rotatable trowel is driven by belts which are connected to the reduction device of the engine and the angle between the surface of revolution of each rotatable trowel and the concrete surface is minutely changeable by using a means for angle adjustment.

Other characteristics of the present invention will be better understood from the following description referring to the attached drawings which show non-limitative embodiments.

BEST MODE OF CARRYING OUT THE INVENTION

Figure 1:
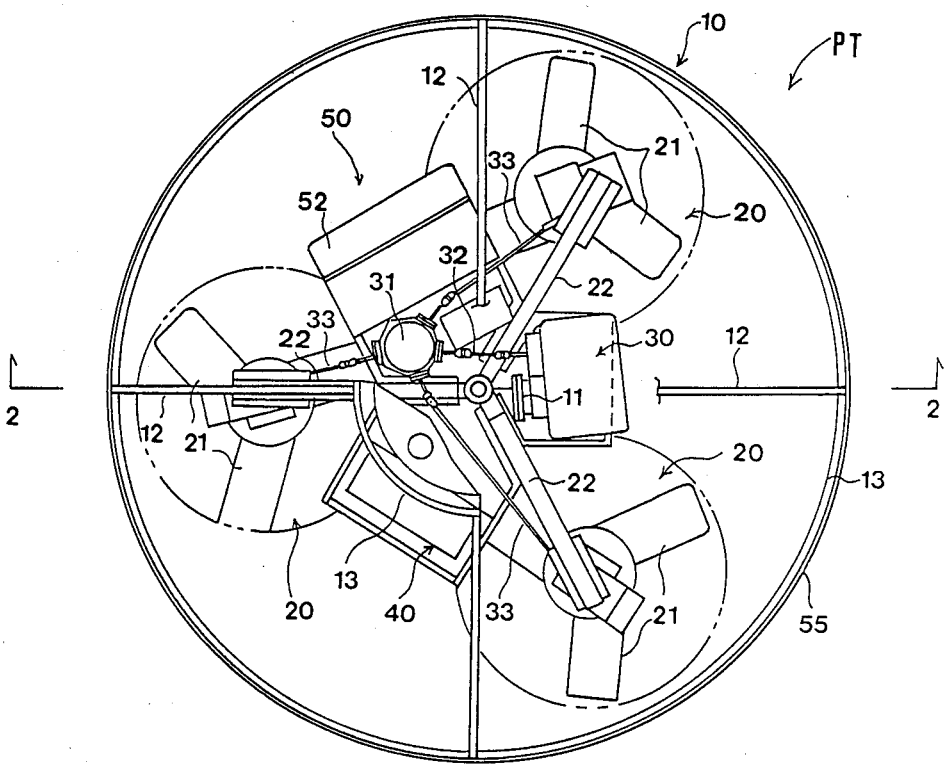
FIG. 1 is a schematic plan view of a finishing machine of concrete surface according to the present invention showing its basic construction.
Figure 2:
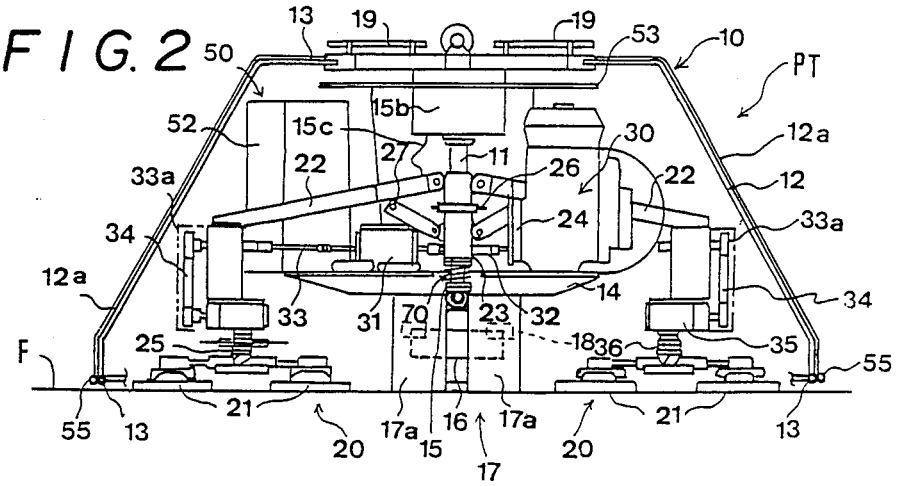
FIG. 2 is a vertical cross-sectional view along the line 2—2 in FIG. 1.
Figure 3:
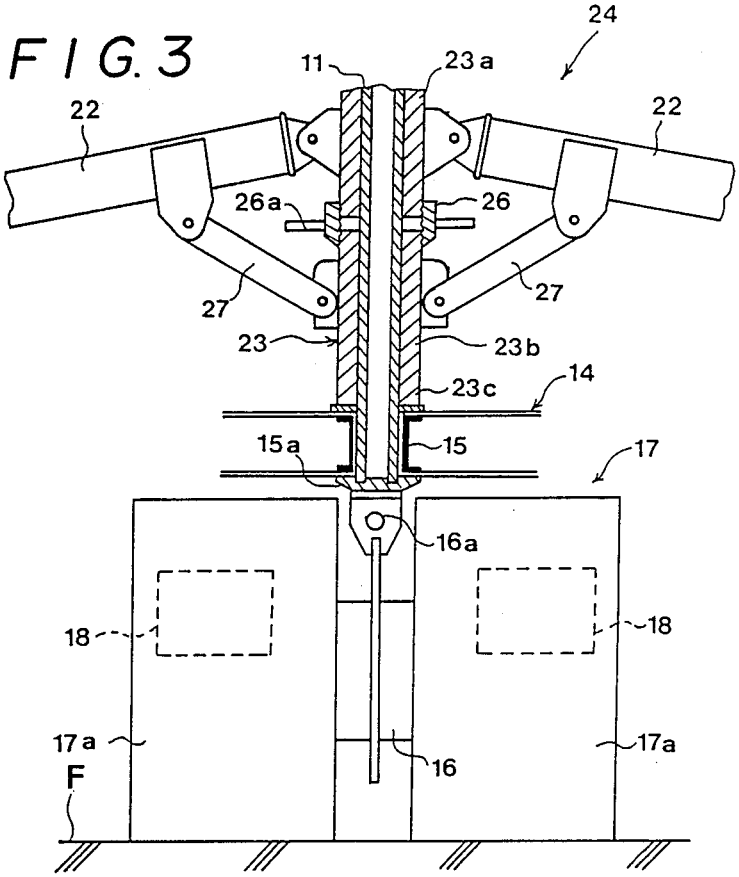
FIG. 3 is a detailed cross-sectional view of the essential part of FIG. 2.

In the following, a finishing machine of concrete surface according to the present invention is explained referring to the attached drawings of a preferred embodiment. FIG. 1 is a plan view showing the whole of a finishing machine of concrete surface according to the present invention; FIG. 2 is a vertical cross-sectional view of the machine by a plane passing through its center; and FIG. 3 is a detailed drawing of the essential part at the lower central portion of the finishing machine shown in an enlarged scale. The finishing machine PT of concrete surface called "Power Trowel" shown in these drawings comprises a body 10 with a traveling means of the finishing machine. Three rotatable trowels 20 are supported rotatably by the body 10 and equipment for driving and controlling the finishing machine are also mounted thereto. The essential part of the body 10 is a central axis 11 positioned at the center. The body 10 travels on a concrete surface F not yet hardened and levels it through the revolution of the rotatable trowels 20 both on their axis and on the central axis 11. The body 10 is in the form of an inversed basket by assembling four radial frames 12 which cross at the central axis 11 and an inside and an outside concentric circular frames 13, 13 so that the outside frame 13 is supported by the frames 12 near the concrete surface F. Furthermore, a protection cover 12*a* is spread over the frames as a sound-proof and dust-proof layer. As shown also in FIG. 3, a deck 14 is supported on the upper surface of a fixed seat 15*a* through a sleeve 15 so that the deck 14 can rorate around the central axis 11 at about the middle height. Just below the fixed seat 15*a*, a frame member 16 is connected detachably thereto by a pin 16*a*. The frame member 16 supports rotatably a pair of right and left traveling rollers 17*a* independently which serve as the traveling means. Each roller 17*a* comprises a driving motor 18 therein. Through the construction explained just above, the central axis 11 and the traveling means 17 are integrated to the body 10. Reference numbers 19 are direction indicating lamps mounted to the body 10 at the top of it along each of the frames 12 in parallel with them. These lamps 19 are supplied with electric power through a slip ring 15*b* and a cable 15*c*.

In contrast to the fixed body 10 described above, the rotatable trowels 20, their driving means 30, a power generator 40 and a control means 50 are mounted to the rotatable deck 14.

First of all, the rotatable trowels 20 comprise three radial trowel blades 21. These rotatable trowels 20 are fixed with their axis of rotation in the vertical direction to the end of three support members 22 which serve as support arms and whose bases are pivotally connected to the central axis 11 with the angle of 120 degrees between them in a horizontal plane. In this way, the rotatable trowels 20 form horizontal mechanical trowels. The bases of the support arms 22 are pivotally supported on the outside surface of a sleeve 23 which is rotatably fitted around the central axis 11 and form with the sleeve 23 a means for angle adjustment 24 of the support arms 22. This means for angle adjustment 24 is for controlling the revolution speed of the rotatable trowels 20 around the central axis 11 by changing the angle between the support arms 22 and the floor surface F and accordingly by modifying that between the rotatable trowels 20 and the concrete surface. Reference number 25 is a means for angle adjustment of the trowels which permits to adjust the angle of each trowel blade 21 of the rotatable trowels 20 from its horizontal position (angle of attack).

The means for angle adjustment 24 is shown in detail in FIG. 3. The sleeve 23 is divided into two portions: the upper portion 23*a* and the lower portion 23*b* which are detachably connected by a reversing screw 26 for adjustment. The bottom 23*c* of the lower portion 23*b* is fixed to the deck 14. In addition, the lower portion 23*b* and the middle portion of each support arm 22 are linked through a link 27 to form a pantograph. By turning the screw 26 for adjustment by means of a handle 26*a*, the relative distance of the upper portion 23*a* with respect to the lower portion 23*b* can be changed and accordingly the end of the support arms 22 changes its position in the vertical direction.

On the other hand, as for the driving means 30 on the deck 14, a gasoline engine 30 is adopted in the present invention. The output power from the engine 30 is transmitted to a gearbox 31 through a universal shaft 32 on the input side and by means of bevel gears therein the driving force is distributed toward each rotatable trowel 20 through a universal shaft 33 on the output side. The driving force is then transmitted successively through a pulley 33*a* at the end of the universal shaft 33, a belt 34 connecting the pulley 33*a* and the rotatable trowel 20 below it at the floor surface F, and a worm gear 35 to rotate the vertical axis 36 of the rotatable trowel 20. In this way, the driving force from the engine is transmitted to the rotatable trowels 20 and they execute the finishing work of the floor surface F.

Figure 4:
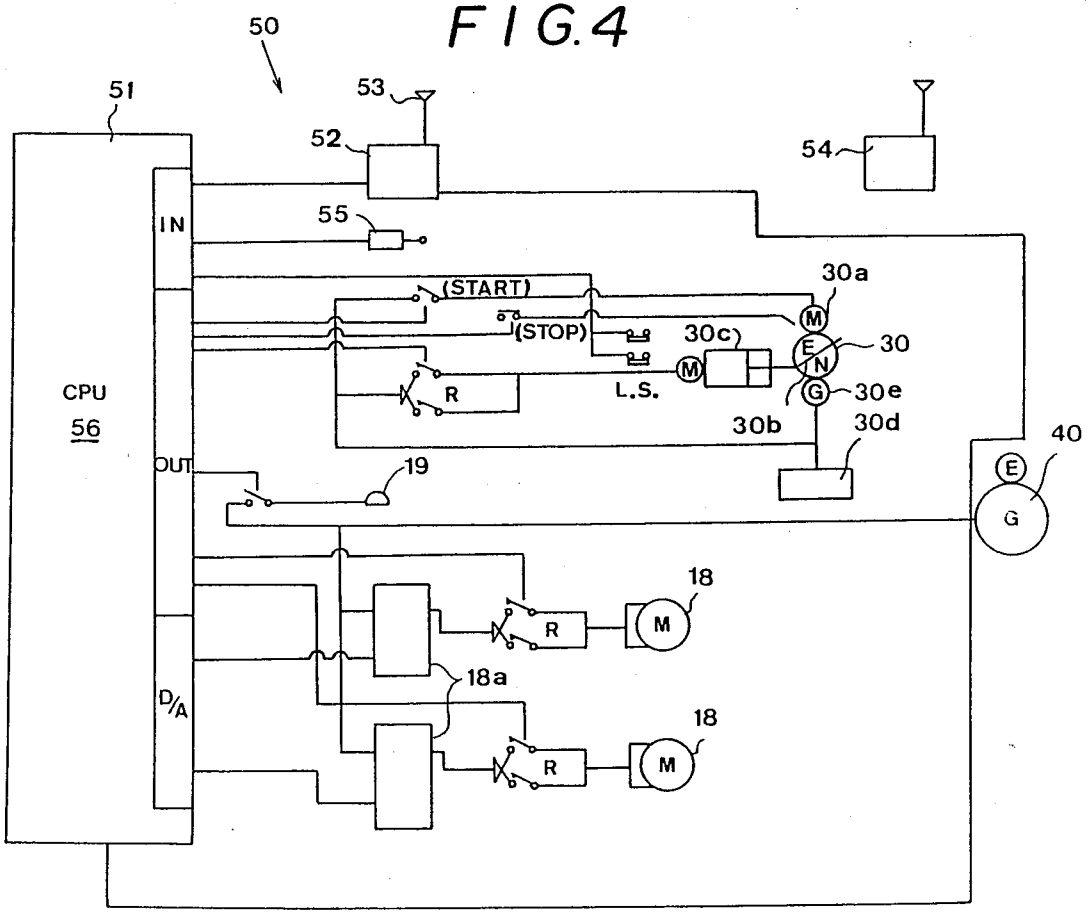
FIG. 4 is a block diagram of a circuit for controlling and driving the finishing machine.

FIG. 4 is a block diagram of a circuit for controlling and driving the finishing machine described above. The power generator 40 comprises a manual starting engine which serves as a power source in general, for example, for the driving motor 18 except for the power supply of the rotatable trowels 20.

The control means 50 is for driving the finishing machine PT of concrete surface and is fed from the power generator 40. The control means 50 comprises a control panel 51, a receiver 52, an antenna 53, a transmitter 54, etc. A touch sensor 55 for detecting an obstacle in traveling which is mounted around the lower circular frame 13 is also connected to this control means 50.

Reference number 56 is a CPU included in the control panel 51. To the input IN of the CPU, the receiver 52 and the touch sensor 55 are connected, while to the output OUT thereof, a cell motor 30*a* of the engine, an electric cylinder for adjusting the throttle lever 30*b* of the engine 30, and the direction indicating lamps 19 are connected. Furthermore, a controlling means 18*a* of the driving motor 18 for driving the left and right rollers 17*a* is connected to the output OUT through a D/A converter. Reference number 30*d* is a battery only for the engine 30, and 30*e* is a power generator for charging the battery attached to the engine 30. The transmitter 54 which is wireless for remote control corresponds to the receiver 52.

The finishing machine PT of concrete surface described above is supported stably as a whole on the floor surface F by the traveling rollers 17*a* and the trowel blades 21 of the rotatable trowels 20. When the traveling rollers 17*a* travel while the rotatable trowels 20 revolve both on their axis and around the central axis 11, the concrete surface is finished by the finishing machine PT.

Figure 5:
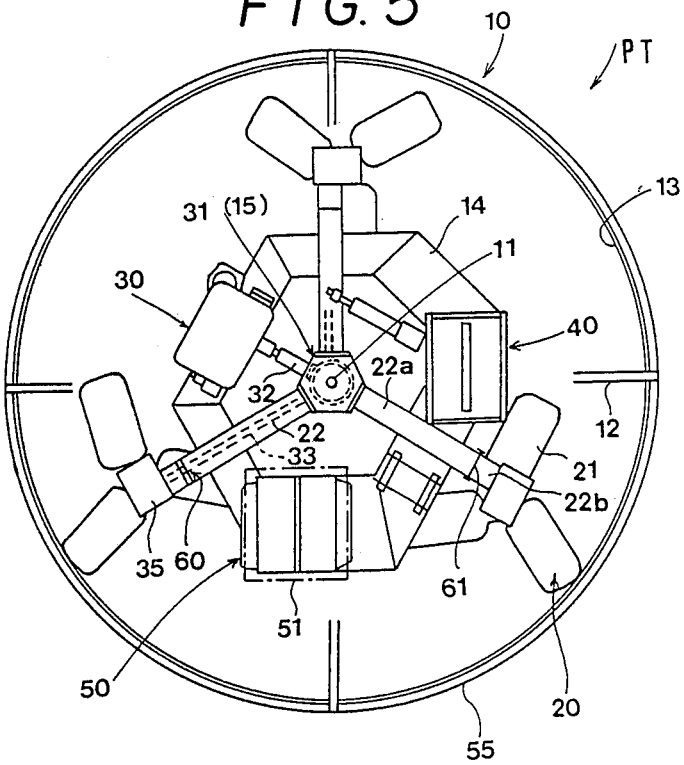
FIG. 5 is a plan view, similar to that shown in FIG. 1, of the second embodiment of a finishing machine of concrete surface including essentially the second invention.
Figure 6:
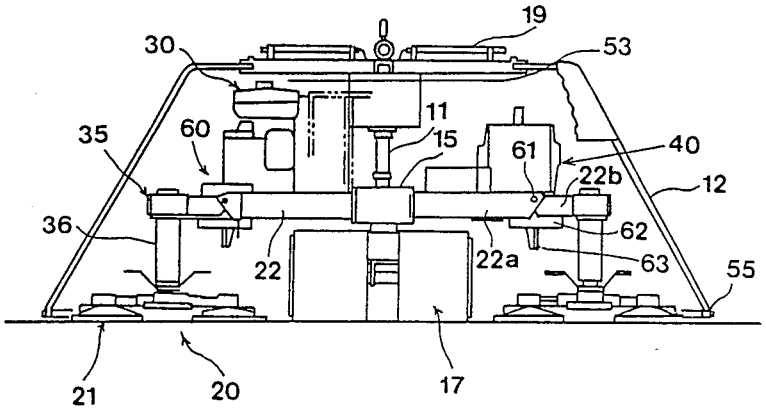
FIG. 6 is a vertical cross-sectional view of FIG. 5.

FIGS. 5 and 6 show the second embodiment according to the second invention. The principal differences from the embodiment described above are that a new means for angle adjustment 60 is formed at the central portion of the support members 22 instead of the means for angle adjustment 24 in the front of a pantograph and that the mechanism of transmitting the output power from the engine 30. Accordingly, in the present embodiment, the base of each support member 22 is solidly connected to a sleeve 15 which is an integrated member between the sleeve in the previous embodiment and the sleeve 23. As for the means for angle adjustment 60, the support arm 22 is divided into two portions at its central portion: a base portion 22*a* and an end portion 22*b*. The end portion 22*b* is connected for bending to the base portion 22*a* through a horizontal connection pin 61 so that the former portion can change its vertical position around the connection pin 61. By giving a small change to the angle between the base portion 22*a* and the end portion 22*b* around the connection pin 61, the angle of attack of the rotatable trowels 20 can be adjusted. As for the means for angle adjustment 60, a screw-type turnbuckle 62 can be used. In this case, both ends of the turnbuckle 62 is respectively fixed to the base portion and the end portion on both sides of the connection pin 61. By handling a lever 63, the turnbuckle 62 is stretched or compressed to give a small change to the axial direction of the support arms 22.

The means for angle adjustment 60 can also be formed at the central portion of the vertical axis 36 of the rotatable trowels 20.

With this structure, the supporting system of the base of the support arms 22 is simplified and the gearbox 31 can be passed through by the central axis 11. The output power from the gasoline engine 30 is transmitted to the gearbox through a universal shaft 32 at the input side. The driving force obtained at the output of the gearbox is transmitted to a transmission shaft 33 which is disposed in the support arms 22 as a universal coupling, then to a worm gear 35 for reducing the rotation speed and for changing the direction of the transmitted force at the end of the support arms 22 and to the rotatable trowels 20 to drive them. Therefore, this embodiment is characterized in that the gearbox 31 can be integrated to the sleeve 15 of the deck 14, which simplifies the pantograph structure of the base of the support arms 22 in the first embodiment and that the transmission shaft 33 of the output of the engine 30 is disposed in the support member 22 in parallel with it, which is an improvement of a complicated transmission system in angular relation using a universal shaft. In this way, the means for angle adjustment 60 not only replaces the means for angle adjustment 24 but also constitutes the second invention which improves the transmission system of the driving force of the engine.

Figure 7:
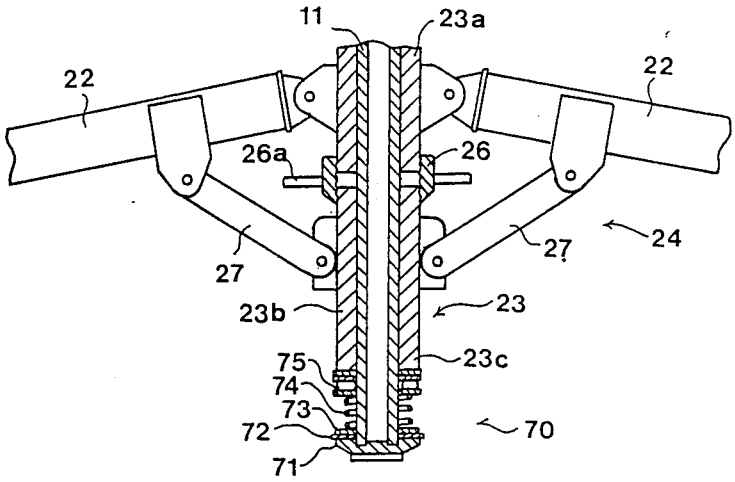
FIG. 7 is a detailed cross-sectional view, similar to that shown in FIG. 3, of an embodiment of the third invention.

The total weight of the finishing machine PT of concrete surface is exerted to the concrete surface as a contact pressure of the rotatable trowels 20 and that of the traveling rollers 17*a*. The ratio between these two kinds of contact pressures depends on the degree of setting of the concrete. Accordingly, in the third invention, a means for adjusting contact pressure 70 is adopted. FIG. 7 shows an example of the means for adjusting contact pressure 70 which is formed between the means for angle adjustment 24 at the upper portion of the central axis 11 and the deck 14. This means for adjusting contact pressure 70 comprises from the bottom a spring seat 71, a washer 72, a shim plate 73, a spring 74 and a thrust bearing 75. By inserting to or taking away from a predetermined position of the central axis 11 the shim plate 73 which is made of a C-like steel plate of the unit thickness, the vertical distance between the spring seat 71 and the bottom 23*c* of the lower sleeve 23*b* is modified to change the above-mentioned ratio through the action of the spring 74.

Figure 8:
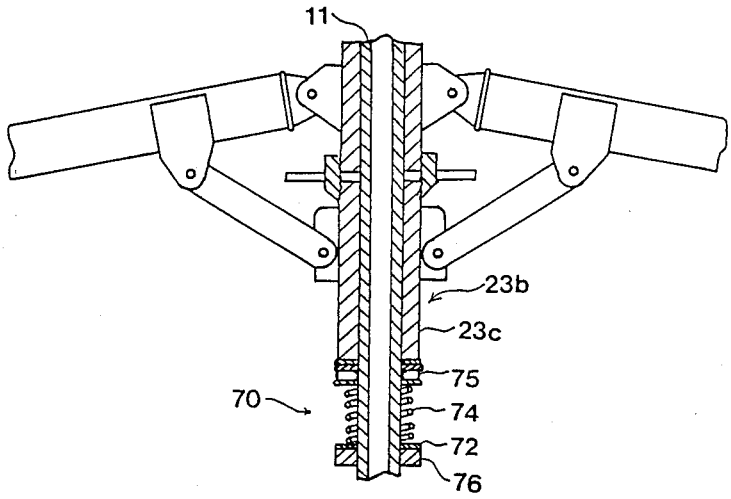
FIGS. 8 and 9 cross-sectional views of other embodiments similar to that shown in FIG. 7.

FIG. 8 shows another embodiment of the means for adjusting contact pressure 70 in which the rise and fall of the lower sleeve 23*b* is realized by cooperating an external thread formed on the outside surface of the central axis 11 at the portion corresponding to the sprihg seat 71 and a nut 76 which replaces the spring seat 71 and by screwing the nut 76 forward or backward along the central axis 11 instead of using the shim plate 73 in the embodiment above. Therefore, the shim plate 73 in the embodiment above is omitted in this embodiment.

Figure 9:
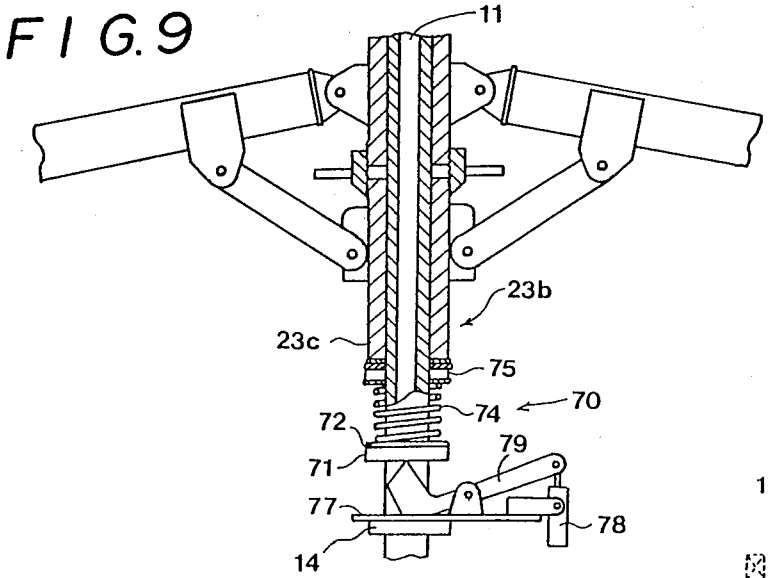

FIG. 9 shows yet another embodiment of the means for adjusting contact pressure 70 in which the rise and fall of the lower sleeve 23*b* is realized by the action of a lever. For this purpose, the spring seat 71 is mounted for vertical translation to the deck 14 and a lever 79 is activated between the spring seat 71 and a fixed seat 77 below it by an actuator 78 such as an electric cylinder.

These means for adjusting contact pressure 70 can be formed in the same manner, when the means for angle adjustment 60 is adopted instead of the means for angle adjustment 24.

Figure 10:
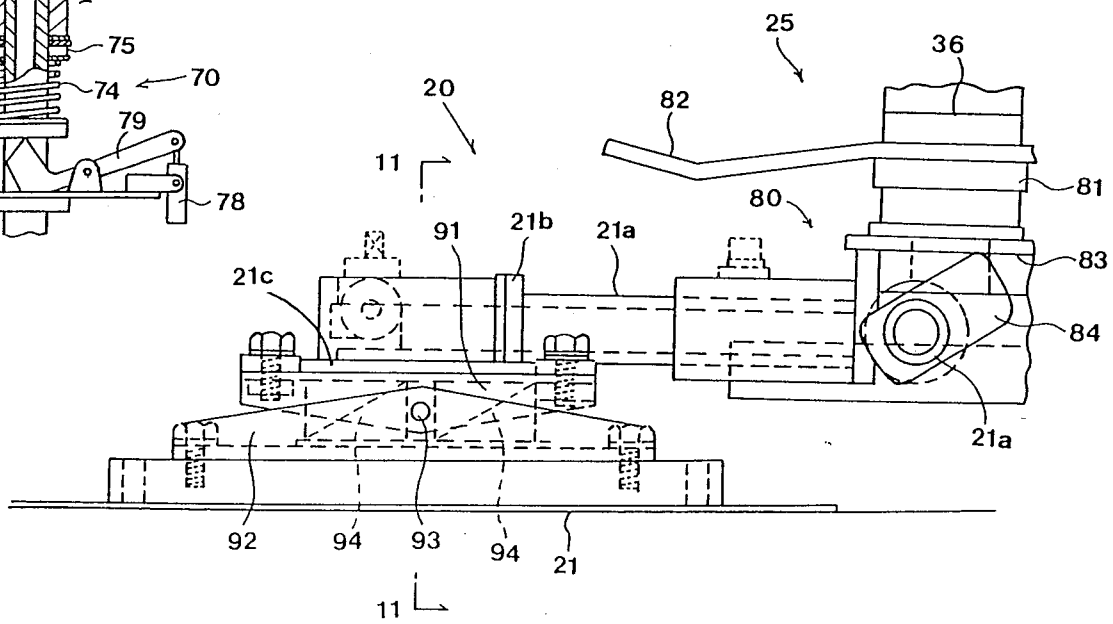
FIG. 10 is a detailed side view of an embodiment of the fourth invention.

Next, a means 25 for adjusting the angle with the concrete surface of the trowels 20 which finish directly the leveling of the concrete is explained referring to FIG. 10. The rotatable trowels 20 in this embodiment are the same as those in the embodiments described above in that they are connected through the vertical axis 36 to the end of the three support arms 22 whose bases are supported by the central axis 11 with the angle of 120 degrees between them and that each trowel blade 21 of the rotatable trowels 20 is connected at the end of the corresponding horizontal radial support arm 21*a* along its direction which is supported at the bottom of the vertical axis 36 so as to form a horizontal mechanical trowel. The vertical axis 36 is equipped at its bottom with a means 80 for adjusting the angle of the trowels. This vertical axis 36 is screwed into the body 81 of this means 80. By turning a lever 82 in a horizontal plane, the bottom 83 of the body 81 is raised. Then, a cam 84 at the base portion of the horizontal support arm 21*a* also turns round to rotate each support arm 21*a*. As a result of the rotation of the support arm 21*a*, the trowel blades 21 which are supported by the support arm 21*a* rotate a little bit to change the angle of attack of the trowel blades 21 with the direction of advance. In this way, the action of the rotatable trowels 20 against concrete can be adjusted to the degree of setting of the concrete. The means for adjusting the angle of the trowels itself had been already known before the present invention was accomplished.

Figure 11:
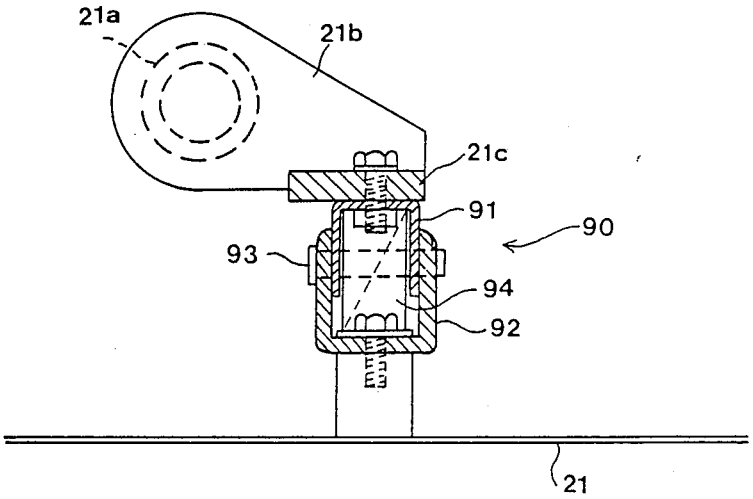
FIG. 11 is a cross-sectional view along the line 11—11 in FIG. 10.
Figure 12:
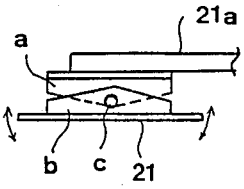
FIG. 12 us a side view corresponding to FIG. 10 for explaining the prior art.
Figure 13:
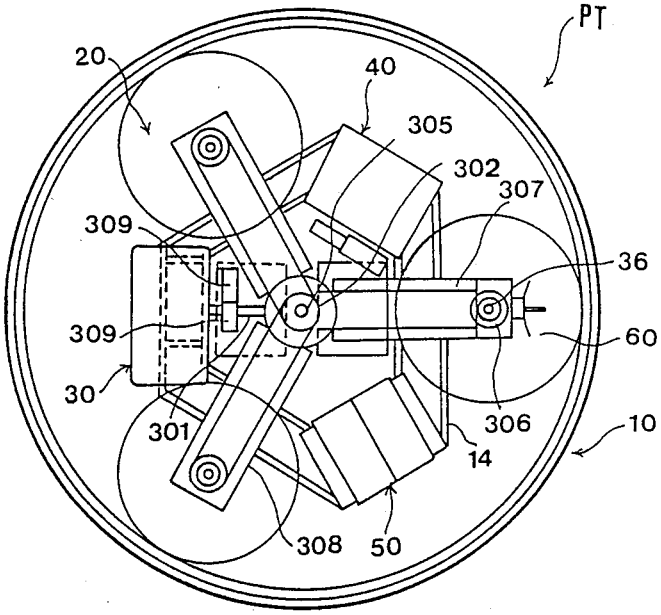
FIG. 13 is a plan view, similar to that shown in FIG. 1, of the third embodiment of a finishing machine of concrete surface including essentially the fifth invention.
Figure 14:
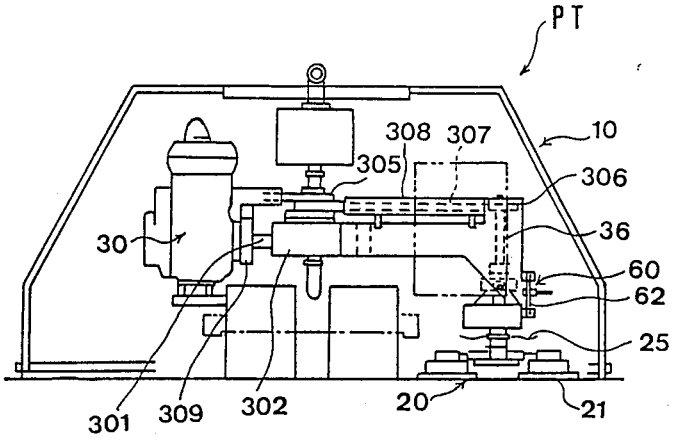
FIG. 14 is a vertical cross-sectional view of the third embodiment.

Next, as the fourth invention, a means 90 for limiting swinging motion of the trowel blades 21 which controls the action of the trowel blades 21 of the rotatable trowels 20 is explained referring to FIGS. 10 to 12. In the prior art, as shown in FIG. 12, the trowel blade 21 was supported for swing around an axis C by the support arm 21*a* through a pair of upper and lower brackets a, b. Therefore, the trowel blade 21 can swing freely according to the profile of irregular floor surface and follows just as the profile of the floor. As a result, the leveling function of the trowel blade 21 has not been sufficient. According to the present invention, a bracket 21*b* and a base plate 21*c* are fixed to the end of the support arm 21*a;* an upper bracket 91 in the form of a squared C whose opening faces downward is fixed to the lower surface of the base plate 21*c;* a lower bracket 92 in the form of a squared C whose opening faces upward is connected to the upper bracket 91 through a pin 93; and the trowel blade 21 is fixed to the lower surface of the lower bracket 92 so that the trowel blade 21 can swing around the pin 93. For connecting these elements, bolts are generally used. Furthermore, according to the present invention, an elastic member 94 such as a rubber in the form of a block is interposed in the space defined by the facing upper and lower brackets. With this structure, not only the swing of the trowel blade 21 is limited by the elastic member 94 but also the trowel blade 21 is supported eccentrically from the support arm 21*a* by the bracket 21*b*, which increases the effect of the means 80 for adjusting the angle of the trowels.

Figure 15:
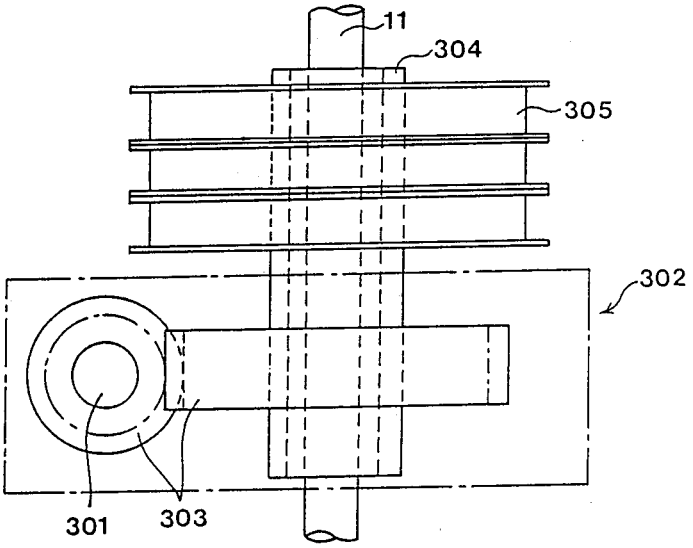
FIG. 15 is a cross-sectional view of the essential part of FIG. 14.

In the following, the fifth invention which relates to the mechanism of transmitting the power for driving the rotatable trowels 20 is described in detail referring to the third embodiment shown in FIGS. 13 to 17. In this embodiment, the gearbox 31 is not used. Instead, the output shaft 301 of the engine 30 is connected to a reduction device 302 at the central axis through a belt. The output power from the reduction device 302 is then transmitted to the rotatable trowels 20 through belts. In the reduction device 302 as shown in FIG. 15, the rotation speed is reduced by a worm gear 303 which is supported by the central axis 11 and has as an input shaft the output shaft 301 of the engine 30, while the direction of the driving force is changed by an output shaft 304 which engages with the central axis 11. Three pulleys 305 are fixed concentrically to the output shaft 304. On the other hand, the vertical axis 36 of the rotatable trowel 20 is supported through a pin at the end of the support arm 22 of each rotatable trowel 20. A pulley 306 which is fixed at the top of the vertical axis 36 and each pulley 305 of the reduction device 302 are connected by a belt 307 which is enclosed with a cover 308. The trowel blade 21 is fixed at the bottom of the vertical axis 36 to constitute the rotatable trowel 20. Therefore, each rotatable trowel 20 is driven by the output from the engine 30 transmitted by belts, and no reduction device is necessary at the portion of belt transmission.

Because the driving mechanism of the support arm 22 is changed in this embodiment so as to be driven by a belt, the means for angle adjustment 60 of the rotatable trowels 20 can be of the minutely bending type which is mounted to the vertical axis 36 and the adjustment may be realized by a turnbuckle 62 just as in the previous embodiment.

Figure 16:
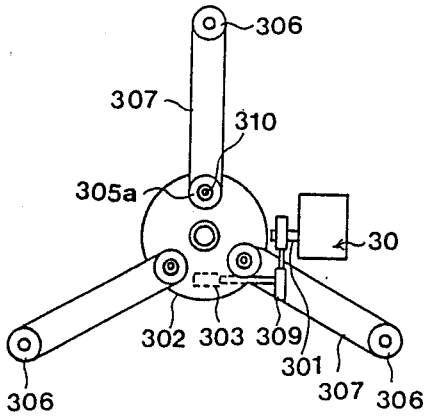
FIG. 16 is a plan view of the essential part of another embodiment.
Figure 17:
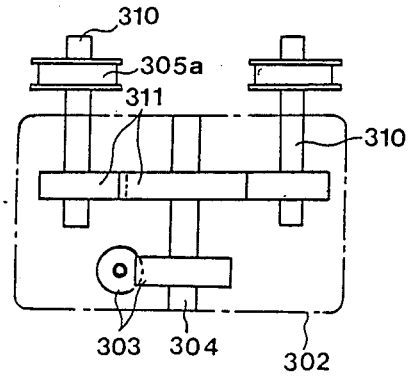
FIG. 17 is a side view of the essential part of FIG. 16.

As for the reduction device 302 shown in FIG. 15, another type of reduction device can be adopted: the plan view of such a reduction device is given as FIG. 16 and its side view is given as FIG. 17. In this embodiment, as shown also in FIGS. 14 and 16, the position of the engine 30 has some freedom and its output shaft 301 rotates the worm gear 303 through a pair of pulley 309 and a belt. In addition, pulleys are not directly fixed to the output shaft 304 of the reduction device 302. Instead, the driving force is distributed to three auxiliary shafts 310 which are included in the reduction device 302 and are equipped with a pulley 305. Each pulley 305*a* is driven by connecting the output shaft 304 and the auxiliary shafts 310 throuh gears. The driving force is transmitted from each pulley 305*a* to the corresponding pulley 306 of each rotatable trowel 20 just as in the previous embodiment. However, this reduction device is advantageous in that the belts 307 are positioned in the same plane. Now, because this fifth invention relates to the transmission mechanism of power from a power source, it is of course possible to construct a finishing machine PT of concrete surface by utilizing the above-mentioned inventins independently or in combination.

Figure 18:
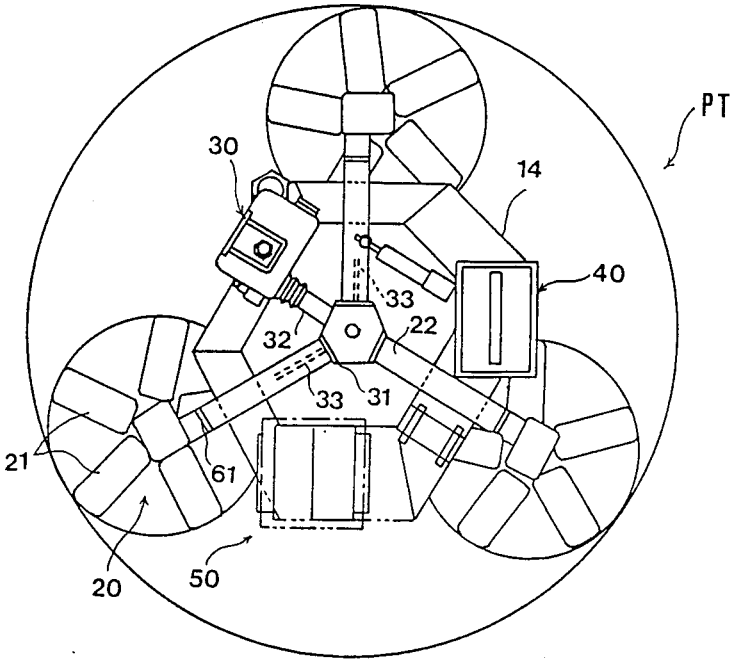
FIG. 18 is a plan view similar to that shown in FIG. 5 with a modification in the number of the trowel blades.

FIG. 18 shows an embodiment of a finishing machine in which the number of the trowel blades 21 of each rotatable trowel 20 is five. For the reason of stability, at least three trowel blades 21 are necessary for a rotatable trowel 20. If the number of the trowel blades 21 are four, contact surface area increases, which is advantageous for increasing the weight of the body, the speed of revolution of the trowel blades 21, and the dimension of the engine. Five trowel blades 21 are more advantageous, but the disposition of the cam of the means for adjusting the angle of the trowels is complicated and the setting of phase difference between the trowel blades 21 of different rotatable trowels 20 is difficult when the latter revolves around the central axis 11. Therefore, there are limitations to the number of trowel blades 21 for each rotatable trowel 20.

Operation

The operation of the finishing machine PT of concrete surface according to the present invention is explained referring to the utilization and control method of the machine. The adoption of the gasoline engine 30 as the driving means of the rotatable trowels 20 in the present invention is not a mere choice of a power supply. Owing to this choice, expenses necessary for constructing a temporary installation for power distribution at the work place are completely omitted. In addition, since the finishing machine PT of concrete surface does not trail cables for power supply in operation, the concrete surface is not damaged. Furthermore, instead of a plurality of power supplies which are respectively mounted to the corresponding rotatable trowel 20 in the prior art, they are integrated to a single engine so as to lighten the total weight and to facilitate the maintenance of the finishing machine. Finally, the transmission of power from the engine 30 to the rotatable trowels 20 is realized by the gearbox 31 which transmits radially the power to each rotatable trowel 20. Therefore, the speed of revolution of each rotatable trowel 20 on its axis is the same.

When the finishing machine PT of concrete surface according to the present invention is driven, signals are emitted from the transmitter 54 to be received by the receiver 52. Then, the CPU 56 of the control means 50 becomes active to start the power generator 40 and then the engine 30. The output from the engine 30 is transmitted to the rotatable trowels 20 to rotate them through the gearbox 31 and the universal shafts 32, 33. As rotatable trowels 20 rotate, the finishing machine PT of concrete surface travels as a whole and the leveling of the concrete surface F is finished. The rotatable trowels 20 revolve not only on their vertical axis 36 but also around the central axis 11 when the support arms 22 supporting them revolve around the central axis 11 by being supported on the floor surface F by the reaction therefrom. In addition to these rotations, the rotatable trowels 20 also travel by means of the traveling means 17 to finish the leveling of the concrete surface. During the finishing work, the traveling rollers 17*a* are controlled independently of the revolution of the rotatable trowels 20 so as to travel straightly or toward a desired direction which is indicated by the direction indicating lamps 19. If the finishing machine PT of concrete surface collides with any obstacle during traveling, the touch sensor 55 becomes active to make the finishing machine PT move backward and then stop. Since the direction indicating lamps 19 go on and off repeatedly in this case, the direction of traveling of the body 10 as a whole is changed or the obstacle is removed. The protection cover 12*a* is provided for the purpose of attenuating the noise, preventing the pollution of the environment by the scattering of "white-washes", and protecting the mechanical portion of the finishing machine PT. In the embodiment in which the gearbox 31 is disposed coaxially with the central axis 11, the structure of the body 10 is extremely simplified because of the simplification of the universal shafts 32, 33 whose angular relation is normally complicated.

Another characteristic of the finishing machine PT of concrete surface according to the present invention consists in the means for angle adjustment 24 or 60 disclosed as the second invention. These means for angle adjustment permit to adjust the angle of the axis of the rotatable trowel 20 with the floor surface by inclining a bit or by bending slightly the support arm 22 for supporting the rotatable trowel 20. This angle adjustment is realized through the pantograph mechanism of the support arms 22 or through the expansion and contraction mechanism of the connection pin 61 and the turnbuckle 62. Through such mechanisms, the means for angle adjustment modifies the angle of the surface of revolution of the rotatable trowel 20 with the floor surface F, and the speed of revolution of the rotatable trowel 20 around the central axis 11 is adjusted to be equal to or less than a tenth of the speed of the axis according to the degree of setting of concrete from the time when the concrete is deposited till the starting up of the finishing machine PT of concrete surface. As a reaction, the speed of revolution of the rotatable trowels 20 as a whole is modified. If this angle adjusting mechanism is utilized inversely, uniform leveling of the floor surface can be realized by controlling the above-mentioned angle and the speed of revolution even for slight irregularities of the floor surface F. The angle adjustment mechanism at the vertical axis 36 is the same for the embodiment in which the vertical axis is driven by a belt.

The means 70 for adjusting the contact pressure according to the third invention permits to adjust at the central axis, the distribution of the whole weight of the body as contact pressure with the floor surface between the contact pressure of the traveling rollers and that of the rotatable trowels. A variety of mechanisms can be adopted for this means 70 for adjusting the contact pressure. Therefore, fast intermediate pushing and finishing of concrete surface can be realized when the deposited concrete is not yet sufficiently hardened.

The means 80 for adjusting the angle of the trowels also contributes to the leveling of concrete surface according to the degree of setting of the concrete. If the angle of the trowel blade 21 with the concrete surface is set small by using this means 80 so as to be adapted to concrete not yet hardened, there occurs no scratching of concrete to lead to high efficiency of leveling its surface. On the contrary, the angle of attack of the trowel blade 21 is set larger for half-hardened concrete so that its surface is sufficiently pressed, which results in a high precision of the finishing work.

The fourth invention, which is the means 90 for limiting swing of the trowel blades 21 which is provided at the supporting portion of the trowel blades 21, is advantageous when there exist local irregularities on the floor surface F. Since an elastic member restricts free swing of the trowel blade 21 around the pin 93 in this means 90 for limiting swing of the trowel blades 21, "minute" leveling work of concrete surface can be realized just as that by manual operations. In addition, the swing of the trowel blade 21 around this region is attenuated so that the leveling work by the finishing machine PT of concrete surface is stably carried out.

It has been found that appropriate leveling pressure of the rotatable trowels 20 of the finishing machine PT of concrete surface is about 0.6 kg/cm. Corresponding weight of the finishing machine PT of concrete surface with three trowel blades for each rotatable trowel is 150 kg. In contrast, when rotatable trowels 20 with four or five trowel blades are used, contact surface area between the trowel blades and the floor surface increases. Accordingly, the weight of the body can be heavier and the difference of the weight permits the utilization of commonly used heavy steel frames for the framework such as the body 10. In this way, not only the expenses for the framework materials decrease but also the strength of the framework increases. Furthermore, since the speed of finishing work increases in principle with the rotatable trowels equipped with more than three trowel blades compared with those with three trowel blades, the speed of revolution of the rotatable trowels 20 can be reduced correspondingly. Therefore, the linear velocity of the periphery of the trowel blades 21 is decreased; higher finishing precision of the concrete surface is obtained; the quantities of "white-ashes" of mortar become smaller; and the lifetime of the trowels is prolonged. At the same time, the load torque for the rotatable trowels 20 is decreased owing to the reduction of the speed of revolution of these rotatable trowels 20, which makes it possible to cut down correspondingly the output from the engine 30. Therefore, an engine with smaller output power may be chosen.

Furthermore, since the rotatable trowels 20 according to the present invention are equipped with the means 90 for limiting swing of the trowel blades 21, the leveling work of concrete surface is carried out quite well by the trowel blades 21 in spite of the existence of irregularities on the actual surface of the concrete. Accordingly, the performance of the finishing machine PT of concrete surface for leveling the concrete surface is improved as desired.

The output from the engine 30 in the third embodiment is transmitted through belts instead of gears. In the fifth invention in which the belt transmission mechanism is adopted and its function is the same as that of gear mechanism, noise generated at the gearbox 31 and the reduction device 35 when the engine is driven is further decreased. In addition, there is given a lot of freedom in positioning the engine 30 on the body 10.

Other operations of the finishing machine PT of concrete surface can be easily understood from those of a mechanized one in the prior art.

Industrial Applicability

In the finishing machine of concrete surface according to the present invention comprising a body which is capable of traveling freely on the concrete surface and is equipped with a plurality of rotatable trowels, a gasoline engine is adopted as a driving means. Therefore, the drawbacks cited before for an electric finishing machine of concrete surface in the prior art are all solved. In addition, electric motors which have been mounted to each rotatable trowel can be integrated to a single engine whose position on the body may be determined as desired. Furthermore, the whole weight of the finishing machine can be reduced. According to the present invention, the rotatable trowel comprises five radial trowel blades and the angle of each trowel blade with the floor surface is changeable. As a result, the rotatable trowels support heavier finishing machine and commonly used heavy steel frames can be used instead of lighter frames. The utilization of the steel frames and a smaller engine make it possible to reduce the cost of fabrication to be about the half of those in the prior art. The noise generated by the engine is also reduced and the lifetime of the body is prolonged. This finishing machine of concrete surface is capable of leveling deposited concrete surface just as by manual operations by following the irregularities of the concrete surface and by leveling it according to the degree of setting with appropriate speed of revolution of rotatable trowels. In this way, the efficiency and precision of the finishing work by the finishing machine is improved by far than before. This effect is worthy of special mention because the finishing machine of concrete surface according to the present invention contributes much to the construction industry.

It is also posible to apply the finishing machine according to the present invention to a polishing machine of hardened concrete surface or to a scavenger by replacing the trowel blades of each rotatable trowel with polishing members or with members for scavenging.

We claim:

1. A finishing machine with a central axis member, said machine comprising:

a plurality of rotatable trowels, each of said trowels having a pivot axis member;

a plurality of trowel blades contained in each of said trowels;

radial support arm pivotally fixed to said central axis member and attached to said rotatable trowels for pivotal movement about said pivot axis member, each of said support arms being comprised of a first and a second portion, said portions being movably connected to one another;

angle adjustment means associated with said support arms, each of said adjustment means being comprised of a turnbuckle whose ends are attached to said first and second portions of said support arms to adjust the angle between said portions;

one gasoline operated driving means attached to said finishing machine for driving said rotatable trowels, said driving means comprising a gear box and transmission shafts attached to said gear box, said shafts and gear box being associated with said rotatable trowels such that each trowel is driven by its own separate shaft;

traveling rollers located radially inwardly of said trowels and near said central axis member; and a power generator for powering said rollers such that when said power generator and said driving means are powered said traveling rollers are operable for movement while said trowels rotate about said central axis member and pivot about said pivot axes members.

2. The finishing machine as claimed in claim 1, wherein the pivot axis member of each rotatable trowel is divided into two parts so that one of the two parts pivots about an axis perpendicular to the other.

3. The finishing machine as claimed in claim 1, further comprising a means for adjustment of contact pressure of the traveling means and of the rotatable trowels with respect to the surface to be finished, said means being mounted at the central axis member.

4. The finishing machine as claimed in claim 3, wherein the means for adjusting contact pressure comprises a spring placed around the central axis member and a shim plate which is insertable about the central axis member for adjustment of the spring force in response to the thickness of the shim plate.

5. The finishing machine as claimed in claim 3 wherein the means for adjusting contact pressure comprises a spring positioned around the central axis member and a spring seat, said spring seat being used to adjust the spring force of said spring by raising or lowering the spring seat.

6. The finishing machine as claimed in claim 3 wherein the means for adjusting contact pressure comprises a spring positioned around the central axis member and a spring seat associated therewith and wherein the central axis member is threaded so that the spring force may be adjusted by turning the spring seat on said threading of said central axis member.

7. The finishing machine as claimed in claim 1 further comprising a means for adjusting the angle of said trowel blades.

8. The finishing machine as claimed in claim 1, further comprising a pin; pairs of upper and lower brackets for supporting said trowel blades, said upper brackets being attached to said rotatable trowels, each pair being connected together by said pin, a trowel blade being rotatably attached to said pin for limited movement thereabout; and an elastic member interposed between said bracket pairs for limiting the relative movement of the trowel blade.

9. The machine of claim 8 wherein said means for angle adjustment comprises the eccentric mounting of said trowel blades with respect to said support arms as well as means to rotate said trowel blades for angular adjustment thereof.

10. A concrete finishing machine with a central axis member, said machine comprising:

a plurality of rotatable trowels each having a pivotal axis;

a plurality of trowel blades contained in each of said trowels;

radial support arms pivotally fixed to said central axis member and attached rotatably to said rotatable trowels for rotation thereof, said support arms being angularly adjustable about said central axis member for controlling the revolution speed of said rotatable trowels;

one driving means for driving all of said rotatable trowels and attached to said finishing machine and comprising a gear box and transmission shafts attached to said gear box, one each of said transmission shafts driving one each of said rotatable trowels;

traveling rollers located radially inwardly of said trowels and near said central axis member;

a power generator for powering said rollers such that when said power generator and said driving means are powered said traveling rollers are operable for movement while said trowels rotate about said central axis and said pivotal axis members.

11. The machine of claim 10 wherein the gear box is positioned coaxially with respect to the central axis member.

12. The machine of claim 10 further comprising angle adjustment means for adjusting the angle of said radial support arms, said adjustment means being located near the central axis member.

13. The machine of claim 10 wherein said support arms are each comprised of a first portion attached to said central axis member and a second portion attached between said trowel and said first portion, said first portions being connected to said second portions such that one of said portions can pivot for angular adjustment about said central axis member by means of said angle adjustment means.

14. The machine of claim 13 wherein said angle adjustment means is comprised of turnbuckle one of each turnbuckle being associated with one of each support arms, the ends of each turnbuckle being fixed to said first and second portions of said support arms so that the angle between said first and second portions can be adjusted.

15. The machine of claim 10 wherein said pivotal axes member of said rotatable trowels are each divided into two parts so that one of said two parts can pivot about an axis perpendicular to the other.

16. The machine of claim 10 further comprising a means for adjustment of contact pressure of said traveling means and of said rotatable trowels, said means being mounted to said central axis member.

17. The machine of claim 10 further comprising a means for angle adjustment of said trowel blades.

18. The machine of claim 10 further comprising a pairs of upper and lower brackets for supporting said trowel blades, one each of said upper and lower brackets being connected together by a pin, said one each of said trowel blades being rotatably attached to said pin for limited movement thereon; and elastic members interposed between said brackets for limiting relative movement of said trowel blades.

19. A finishing machine with a central axis member, said machine comprising:

a plurality of rotatable trowels each having an axis of pivot;

a plurality of trowel blades contained in each of said trowels;

radial support arm pivotally fixed to said central axis member and attached rotatably to said trowels, said support arms being angularly adjustable about said central axis member for controlling the revolution speed of said rotatable trowels;

driving means attached to said finishing machine, said driving means comprising belts and reduction device connected to said belts, said belts driving said rotatable trowels;

traveling rollers located radially inwardly of said trowels and near said central axis member; and a power generator for powering said rollers such that when said power generator and said driving means are powered said traveling rollers are operable for movement while said trowels rotate about said central axis member and said pivotal axes.

* * * * *